US006902462B2

(12) United States Patent
Treibitz et al.

(10) Patent No.: US 6,902,462 B2
(45) Date of Patent: Jun. 7, 2005

(54) CLOSURE FOR A DOLL WITH KEEPSAKE PHOTO

(76) Inventors: Laura Treibitz, 36 Sheffield Dr., Warrick, NY (US) 10990; Lloyd Treibitz, 36 Sheffield Dr., Warrick, NY (US) 10990

( * ) Notice: Subject to any disclaimer, the term of this patent is extended or adjusted under 35 U.S.C. 154(b) by 0 days.

(21) Appl. No.: 10/461,509

(22) Filed: Jun. 16, 2003

(65) Prior Publication Data

US 2004/0253900 A1 Dec. 16, 2004

(51) Int. Cl.[7] ..... A63H 3/02
(52) U.S. Cl. ..... 446/369
(58) Field of Search ..... 446/369, 370, 446/371, 372, 373, 374, 375, 99; 383/77, 78, 42

(56) References Cited

U.S. PATENT DOCUMENTS

| | | | | |
|---|---|---|---|---|
| 2,347,405 A | | 4/1944 | Ford | |
| 2,688,435 A | * | 9/1954 | Vogt | 383/37 |
| 3,186,626 A | * | 6/1965 | Shvetz | 383/37 |
| 4,819,806 A | * | 4/1989 | Pistner | 206/554 |
| 5,695,064 A | * | 12/1997 | Huang et al. | 206/554 |
| 6,109,196 A | * | 8/2000 | Silber | 112/475.08 |
| 6,439,946 B1 | * | 8/2002 | Schneider | 446/73 |
| 6,527,617 B1 | | 3/2003 | Capozzi et al. | |
| 6,547,633 B2 | * | 4/2003 | Haug | 446/369 |
| 6,685,532 B1 | * | 2/2004 | McLean | 446/369 |
| 2001/0046828 A1 | | 11/2001 | Morris | |
| 2002/0168919 A1 | | 11/2002 | Perkins | |
| 2003/0027487 A1 | | 2/2003 | Haug | |
| 2004/0013322 A1 | * | 1/2004 | Taylor | 383/62 |

* cited by examiner

*Primary Examiner*—Derris H. Banks
*Assistant Examiner*—Faye Francis
(74) *Attorney, Agent, or Firm*—Richard C. Litman

(57) ABSTRACT

The closure for a doll with keepsake photo is a closure for closing a filling opening in a stuffed toy. In a stuffed toy constructed of a fabric shell with a hollow interior, a filling conduit is joined to the fabric shell adjacent to a filling opening in the fabric shell. The filling conduit is in communication with the hollow interior of the fabric shell for the insertion into the fabric shell of a filling material. Sealing flaps, having a pocket for receiving a keepsake, are disposed on the filling conduit, and coated with a heat-activated adhesive for sealing the filling conduit closed. Outer closure ties are attached to the fabric shell surrounding the filling opening. The outer closure ties can be tied together to close the filling opening. When the closure is located on the front of a doll, the resulting knot gives the appearance of the dolls bellybutton.

8 Claims, 7 Drawing Sheets

CLOSURE FOR A DOLL WITH KEEPSAKE PHOTO

BACKGROUND OF THE INVENTION

1. Field of the Invention

The present invention relates to stuffed children's toys. More specifically, the invention is a closure for a doll with a keepsake photo. An opening in the doll, used to fill the doll with a filling material, is closed by closure ties that, when tied, give the appearance of an anatomical feature such as a navel.

2. Description of the Related Art

Stuffed toys such as animals and dolls have been popular with children for many years. Children might collect many stuffed animals and dolls, and keep them as sentimental keepsakes into adulthood.

Stuffed toys typically have a fabric shell, with a hollow interior, that is made in the shape of an animal, a baby, or some other figure. The hollow interior is filled with a soft stuffing material such as foam before the fabric shell is sealed shut. It is common for stuffed toys to be manufactured with an opening left in the fabric shell through which the stuffing may be added later. An advantage of this is that the shells may be shipped less expensively, weighing less and taking less space than the filled stuffed toy. Additionally, the empty, fillable, stuffed toy shells lend readily to the retail sale of "make it yourself" stuffed toys, where children and other customers select a stuffed toy shell, fill it, and customize their stuffed toy with clothes, decorations, and other finishes.

Once the toy has been filled, of course, it must be sealed closed. A variety of closures have been used. Some stuffed toys are sewn shut, while hook and loop fasteners, buttons, zippers, or other closure means seal others. Sewing the toy closed has the advantage that the toy cannot be opened and it's stuffing spilled out. With a closure that can be reopened, such as hook and loop fasteners, buttons, and zippers, a child could open her toy and spill out the stuffing. In particular when a toy was originally stuffed by a machine, the child or parent's attempt to re-stuff the toy may leave the toy permanently disfigured. However, an advantage of a closure that is readily reopened is that a keepsake may be secreted inside of the toy and retrieved, perhaps years later, to provide a warm and sentimental memory.

Stuffed toys have been provided with dual closures, having an inner closure to retain a stuffing material and an outer closure to give the toy a more finished look. Generally, a filling tube is affixed to an opening in the toy's fabric shell, the filling tube being made of a fabric or cloth. A means to close the filling tube, such as hook and loop fasteners or a drawstring, is provided to close the filling tube. Additionally, a separate means is provided to close the opening in the fabric shell. Often, this closure is a zipper or Velcro. Such a dual closure provides the ability to open the toy's fabric shell without spilling the stuffing material. However, because the filling tube is typically uses a closure that is readily re-opened, the possibility remains that a child could open up her stuffed toy and spill out the stuffing.

U.S. Pat. No. 6,527,617, issued on Mar. 4, 2003 to L. Capozzi et al., discloses a stuffed toy and a method of making a personalized stuffed toy. The toy comprises a fabric outer shell, with an opening for filling. A flexible conduit is secured to the outer shell, adjacent to the opening. The opening in the outer shell is closed by a lock-stitch or hook and loop fasteners, while the flexible conduit is closed by a lock-stitch or a zipper.

U.S. patent application Publication 2003/0027487 of J. Haug, published on Feb. 6, 2003, discloses a drawstring closure for a stuffed toy. An opening in the toy's fabric shell is simply drawn shut with a drawstring.

U.S. Pat. No. 2,347,405, issued on Sep. 24, 1942 to G. Ford, discloses another stuffed doll having an opening for stuffing the doll that is closed with a drawstring.

U.S. patent 2001/0046828 of M. Morris, published on Nov. 29, 2001, discloses a doll having a self-contained storage compartment used to store accessories such as doll clothes. The doll is molded from a soft and liable plastic material with a hollow interior, and has an opening into the hollow interior. A piece of plastic or fabric covers the opening, and is held closed by hook and loop fasteners, buttons, snaps, or a zipper.

U.S. patent application Publication 2002/0168919 of J. Perkins, published on Nov. 14, 2002, discloses a plush toy with en embedded prize. A prize is contained inside of the stuffed toy along with the toy's filling.

None of the above inventions and patents, taken either singly or in combination, is seen to describe the instant invention as claimed. Thus a closure for a doll with a keepsake photo solving the aforementioned problems is desired.

SUMMARY OF THE INVENTION

The closure for a doll with keepsake photo is a dual closure for a stuffed doll or toy that includes a holder for a keepsake such as a photo.

The present invention includes a stuffed doll or stuffed toy made of a number of pieces of cloth, sewn together to form a fabric shell with a hollow interior. The fabric shell has the shape of a doll, animal or other figure. An opening is left through the outer shell, through which a filling material may be added to the interior.

A filling conduit is affixed to the fabric shell around the opening. The filling conduit is essentially a tube formed of fabric, with one end of the tube fastened to the shell and the other end left open. Thus, a filling material may be inserted into the interior of the fabric shell through the filling conduit.

Cloth tabs, coated on one side with a head-activated adhesive, are affixed to the end of the filling conduit so that, after the toy has been filled, heat-sealing the tabs together securely closes the filling conduit. One or more of the tabs may have a clear pocket where a memento, such as a photo of a child, may be held. Thus, as a person participates in the making of their personalized doll, a photo or other keepsake may be placed inside to provide a future sentimental memory.

With the filling conduit sealed closed, the filling conduit may be tucked inside the doll, through the opening in the fabric shell. This leaves the opening in the fabric shell to be closed. One way to hold closed the opening in the fabric shell is with hook and loop fasteners. Another approach, especially where the stuffed toy is a baby doll, uses closure ties that, when tied together, form a knot. With the closure located on the front of a stuffed baby doll, the knot gives the appearance of the baby's navel or bellybutton.

Accordingly, it is a principal object of the invention to provide a closure for a doll with keepsake photo that securely retains filling material within the interior of a stuffed toy.

It is another object of the invention to provide a closure for a doll with keepsake photo that securely retains filling material within the interior of a stuffed toy while allowing access through the outer shell to a keepsake stored within the stuffed toy.

It is a further object of the invention to provide a closure for a doll with keepsake photo that includes an inner closure for securely retaining filling material and an outer closure for accessing a keepsake.

Still another object of the invention is to provide a closure for a doll with keepsake photo that includes an inner closure for securely retaining filling material and an outer closure that has the appearance of a navel.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
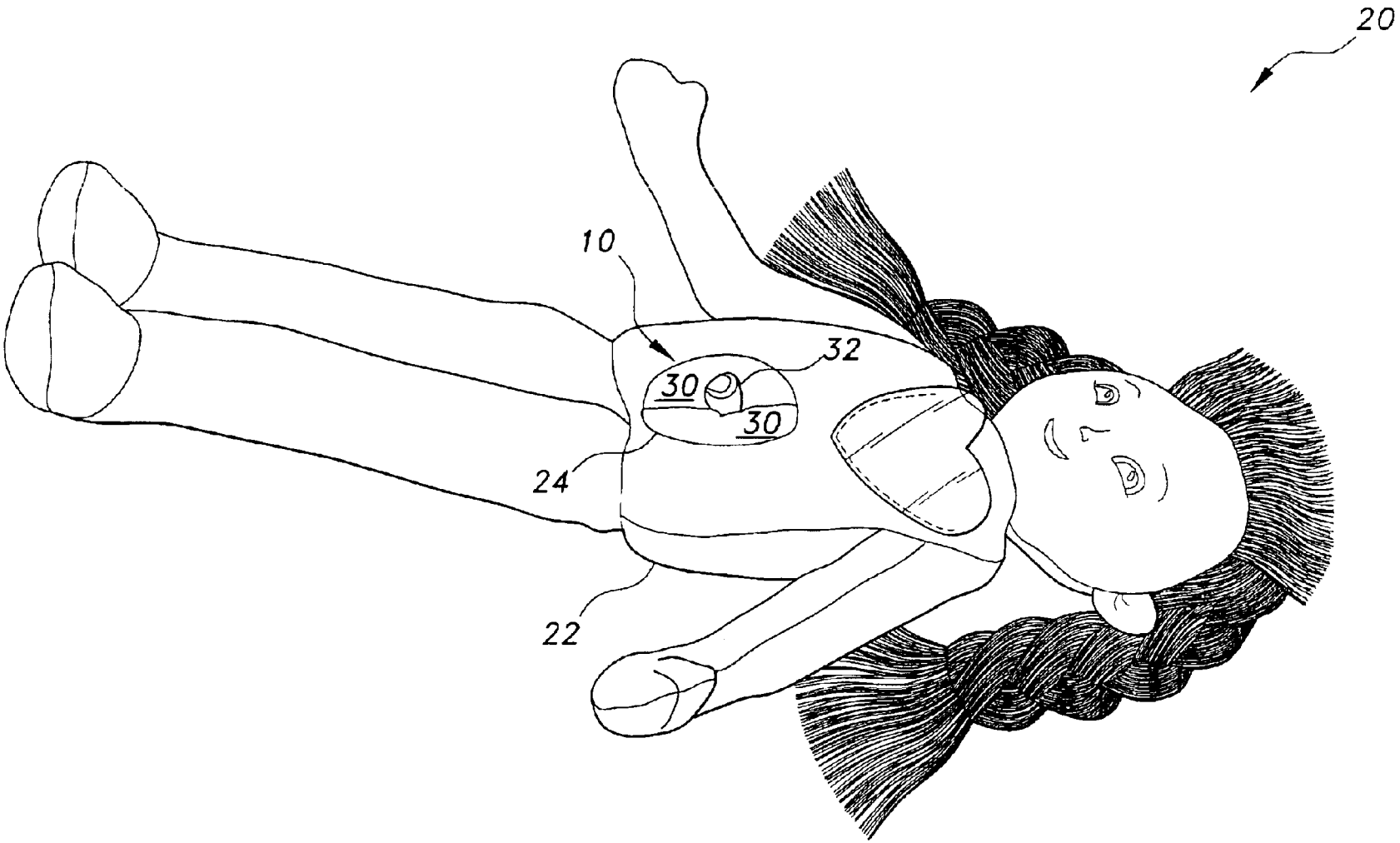
FIG. 1 is a perspective view of stuffed doll having a closure for a doll with keepsake photo according to the present invention, with an outer closure knotted to give the appearance of a navel.

The present invention is a closure for a doll with keepsake photo, designated generally as 10 in the drawings. The closure for a doll with keepsake photo 10 provides a dual closure for stuffed toys and particularly for stuffed dolls. While the closure for a doll with keepsake photo 10 is a useful closure for any type of stuffed toy, doll, or animal, it is particularly well suited as a closure for a stuffed doll. The closure for a doll with keepsake photo 10 is illustrated in a stuffed doll, the stuffed doll being designated generally as 20 in the drawings.

Turning to FIG. 1, a stuffed doll 20 is typically formed from a number of pieces of fabric that are sewn together to form a fabric shell 22 with a hollow interior. The fabric shell 22 has the outward appearance of a doll, typically a human child or infant. A filling opening 24 is left in the fabric shell 22, through which a filling material may be placed inside the fabric shell 22. In the preferred embodiment of the closure for a doll with keepsake photo 10 seen in FIG. 1, with the stuffed doll 20 in a completely assembled state, the closure for a doll with keepsake photo 10 is formed on the front of the stuffed doll 20 generally in the area of the "belly" of the stuffed doll so that, when closed, the closure for a doll with keepsake photo 10 will appear to be the doll's "belly button". An outer closure is formed by a pair of outer closure ties 30 that are secured to the fabric shell 22 along the edges of the filling opening 24. The outer closure ties 30 are tied together to form a knot 32, drawing the outer closure ties 30 together to close the filling opening 24. Loose ends of the outer closure ties 30 are trimmed from the knot 32, leaving the knot 32 to provide the appearance of the doll's belly button.

Figure 1A:
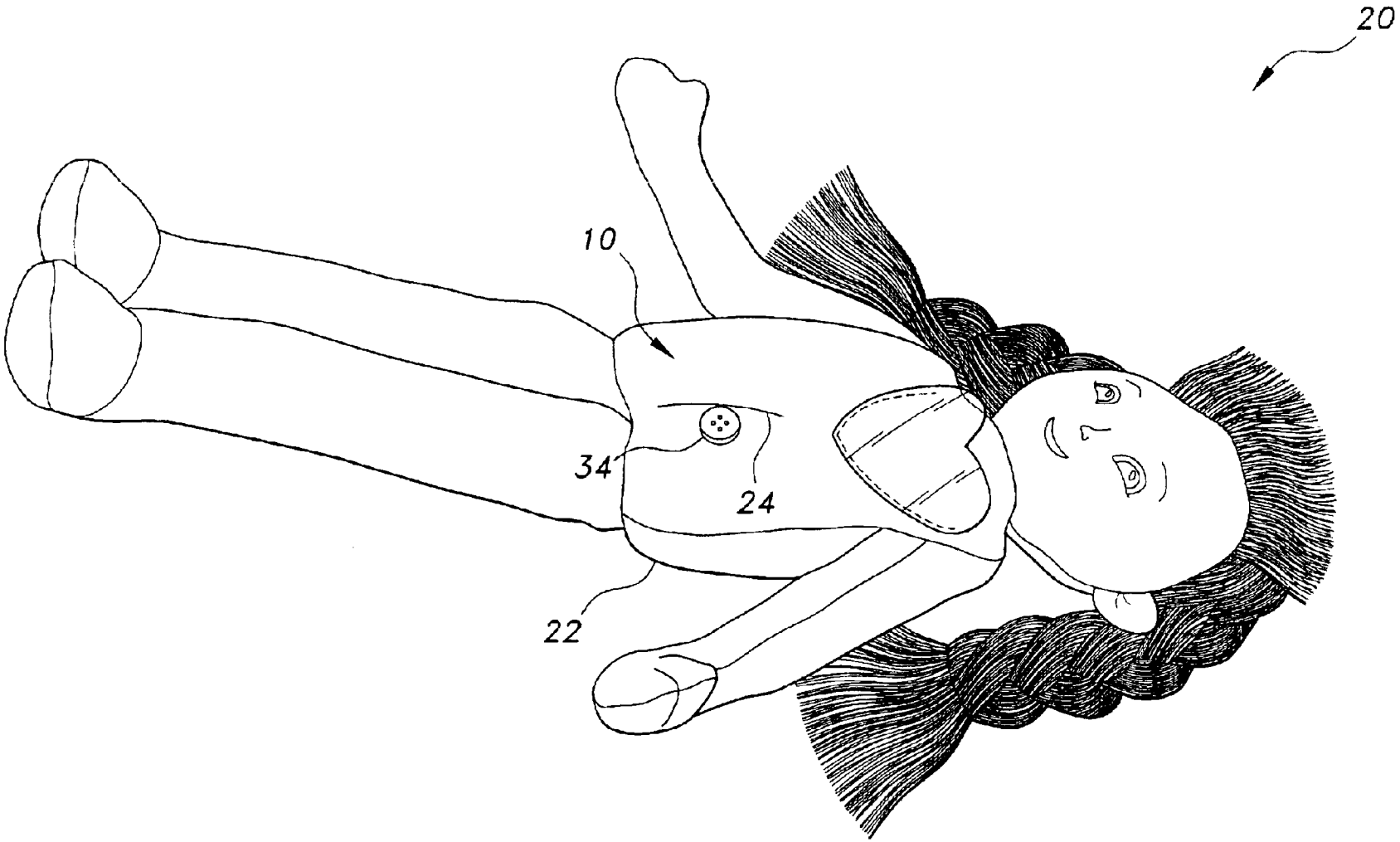
FIG. 1A is a perspective view of a stuffed doll having an alternate embodiment of the closure for a doll with keepsake photo according to the present invention, wherein a button is affixed to a hook and loop fastener outer closure to give the appearance of a navel.

In an alternative embodiment illustrated in FIG. 1A, the filling opening 24 is closed by hook and loop fasteners, and a button 34, affixed to the fabric shell 22 adjacent to the filling opening 24, serves as the doll's belly button.

Figure 2:
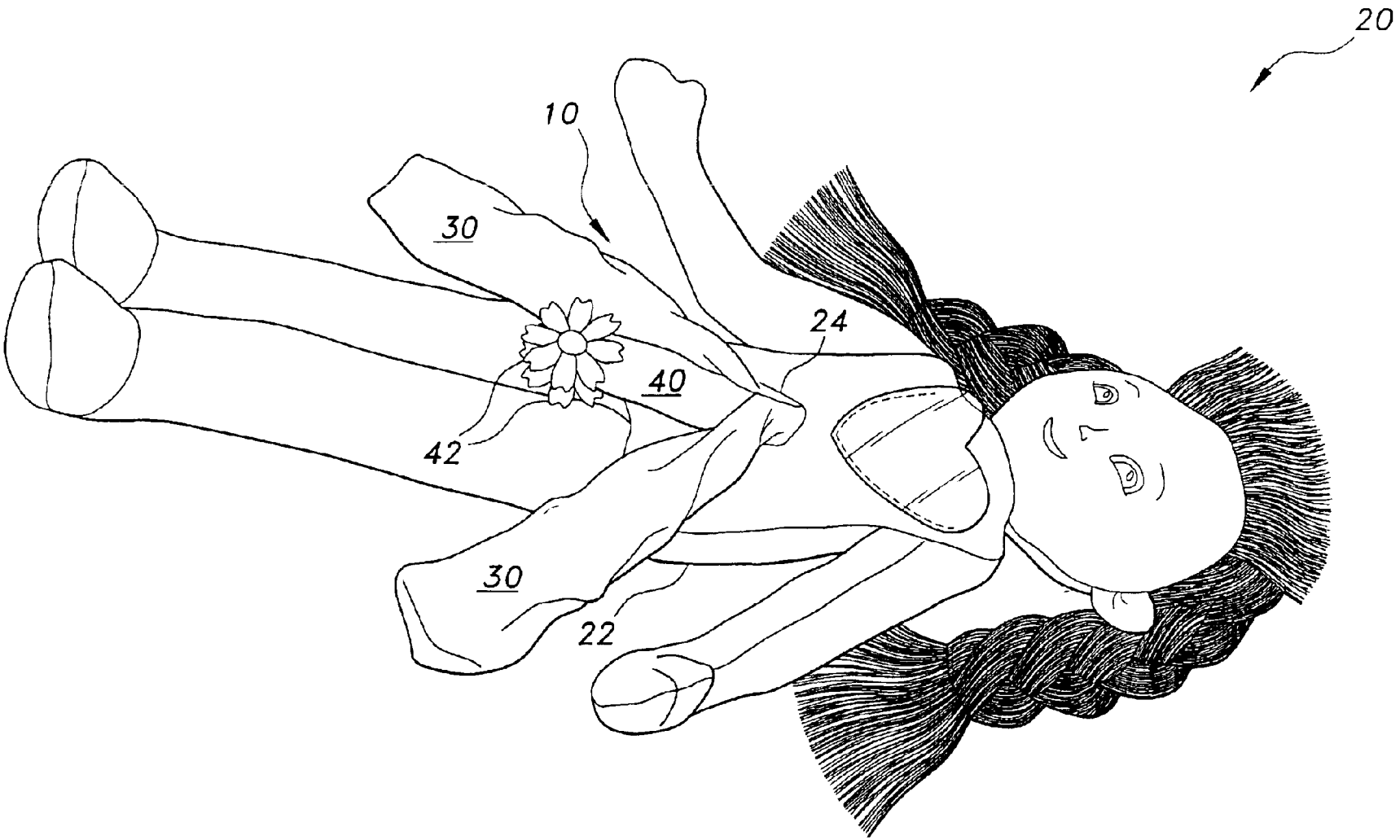
FIG. 2 is a perspective view of a stuffed doll having a closure for a doll with keepsake photo according to the present invention, showing a filling conduit and outer closure ties.

Referring to FIG. 2, the preferred embodiment of the closure for a doll with keepsake photo 10 is seen in greater detail. A filling conduit 40, which is a tube formed of a fabric, is joined at one end to the fabric shell 22 around the filling opening 24. Sealing flaps 42 are disposed on the other end of the filling conduit 40. The sealing flaps 42 are constructed of a heavy fabric, or other suitable material, and may be fashioned in any decorative shape such as the flower shape illustrated in FIG. 2. The outer closure ties 30 are affixed to the fabric shell 22 around the filling opening 24, surrounding the filling conduit 40. The outer closure ties 30 are strips of fabric, and preferably a lightweight, pliable fabric such as nylon.

Figure 3:
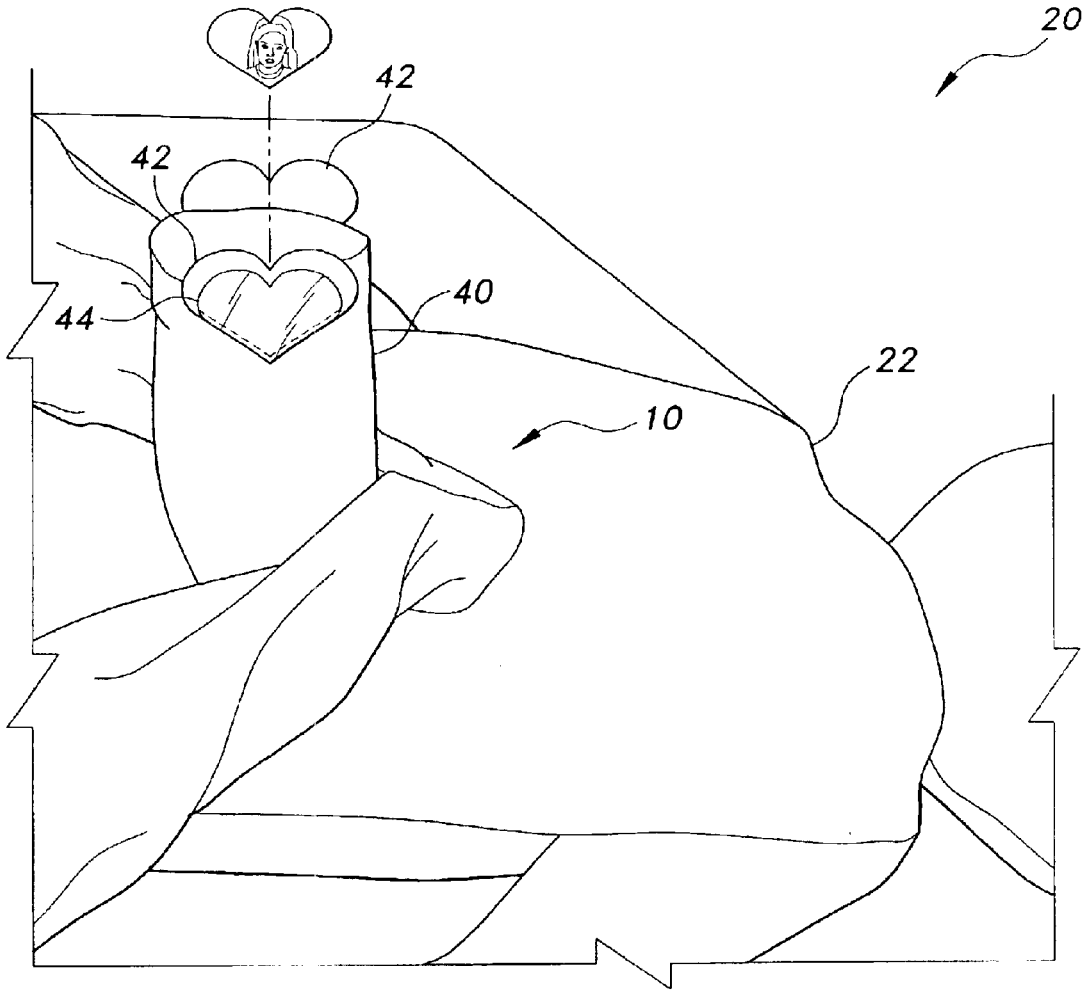
FIG. 3 is a fragmented perspective view of a stuffed doll having a closure for a doll with keepsake photo according to the present invention, showing the filling conduit in greater detail.

The filling conduit 40 is seen in greater detail in FIG. 3. The filling conduit 40, made from a fabric material such as nylon, is in communication with the interior of the fabric shell 22 so that a filling material may be passed through the filling conduit and into the fabric shell 22, filling the stuffed doll 20. The sealing flaps 42, shown here in a decorative heart shape, have a heat-activated adhesive coated on one side, so that the filling conduit 40 may be sealed closed by heat-sealing the sealing flaps 42 together. Additionally, a pocket flap 44 is disposed on one or more of the sealing flaps 42 to form a pocket for receiving a photo or other memento. The pocket flap 44 is preferably made of a transparent material, such as transparent plastic.

After the stuffed doll 20 is filled, the filling conduit 40 is sealed closed by using a heat source, such as an iron, to activate the heat-activated adhesive and bond the sealing flaps 42 together.

Figure 4A:
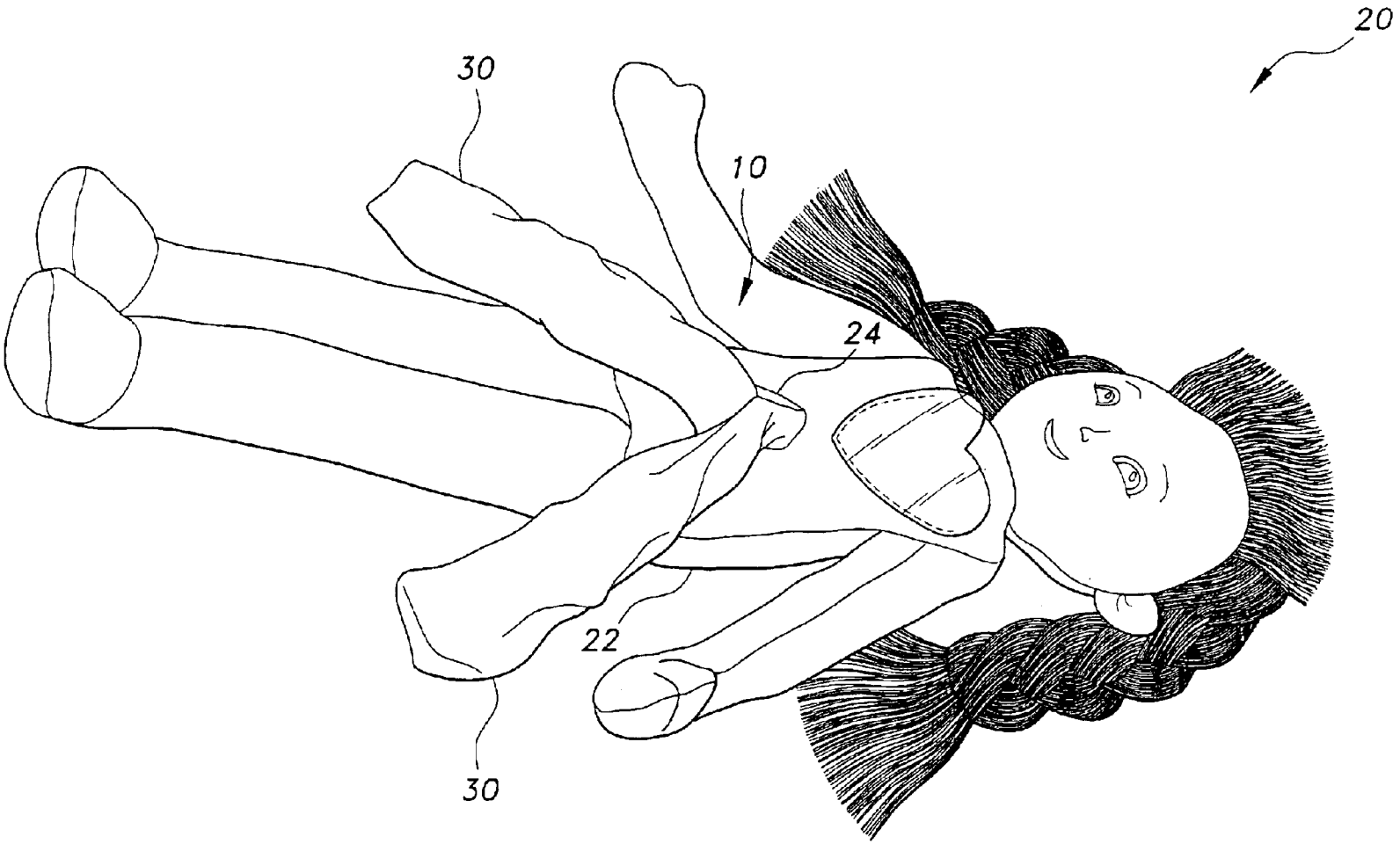
FIG. 4A is a perspective view of a stuffed doll having a closure for a doll with keepsake photo according to the present invention, with the filling conduit tucked inside and showing the outer closure ties.
Figure 4B:
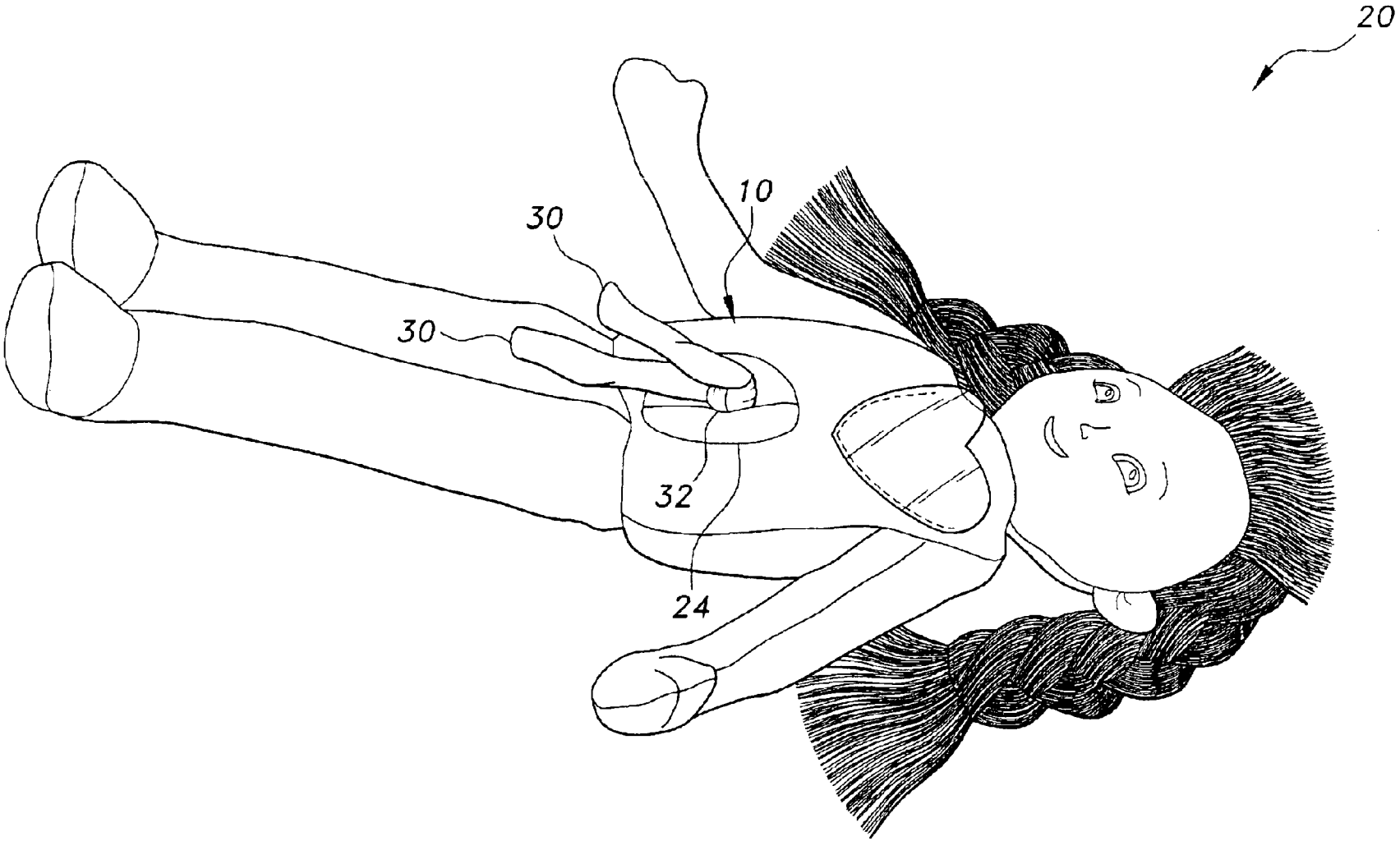
FIG. 4B is a perspective view of a stuffed doll having a closure for a doll with keepsake photo according to the present invention, showing the outer closure ties knotted to close the outer closure.

Turning now to FIG. 4A, the filling conduit 40 is tucked inside of the fabric shell 22 through the filling opening 24 after it is sealed closed, leaving the outer closure ties 30 to be tied together to close the filling opening 24. With the stuffed doll just "born" through the process of filling it, sealing closed the filling conduit 40, and tucking away the filling conduit 40, the remaining outer closure ties 30 resemble an umbilical cord that may be tied and cut. FIG. 4B shows the stuffed doll 20 with the outer closure ties 30 tied together into a knot 32, closing the filling opening 24. The loose ends of the outer closure ties 30 may now be cut to leave knot 32 as the stuffed doll's belly button.

Figure 5:
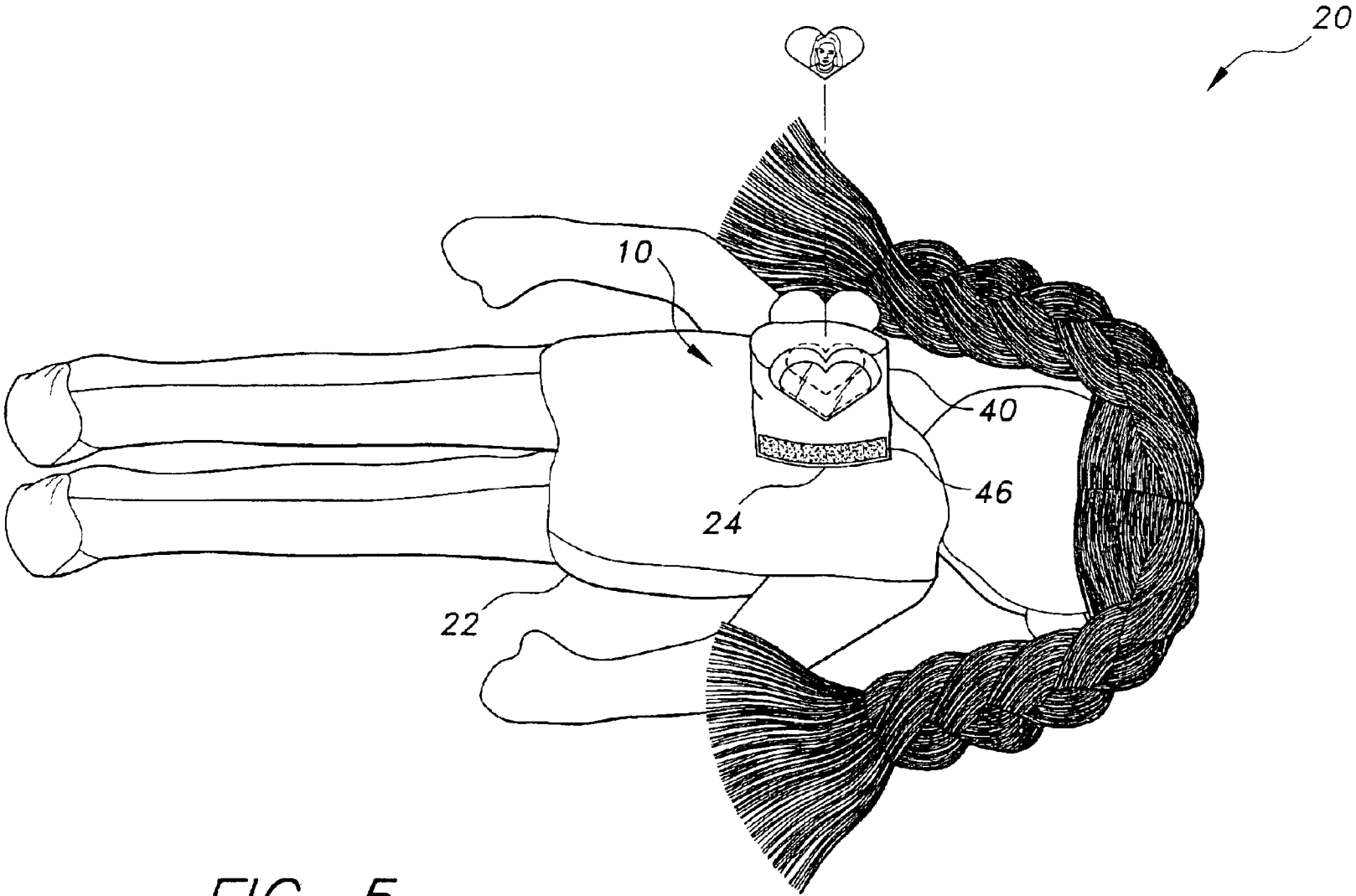
FIG. 5 is a perspective view of a doll having an alternate embodiment of the closure for a doll with keepsake photo according to the present invention, wherein the closure is located on the back of a stuffed doll and the outer closure is closed with hook and loop fasteners.

In an alternate embodiment of the closure for a doll with keepsake photo 10, illustrated in FIG. 5, the outer closure ties 30 are eliminated. Hook and loop fastener strips 46 (only one seen) are disposed on the filling conduit 40. The strips are located on the outside of the filling conduit 40 as the filling conduit 40 is extended from the fabric shell 20, and are adjacent to the edges of the filling opening 24. Arranged in this manner, the hook and loop strips 46 are brought together when the filling conduit 40 is tucked through the filling opening 24 and into the fabric shell 22, turning the filling conduit inside out. With the filling conduit 40 tucked through the filling opening 24, the hook and loop strips are brought face-to face to seal the filling opening 24 closed.

It is to be understood that the present invention is not limited to the embodiments described above, but encompasses any and all embodiments within the scope of the following claims.

We claim:

1. A closure for a doll with keepsake photo, comprising:

a fabric shell having a filling opening defined therein, the fabric shell having a hollow interior, the filling opening being in communication with the hollow interior of the fabric shell;

a filling conduit having a free end and a secured end, the secured end being secured to said fabric shell adjacent to said filling opening, the free end being in communication with said hollow interior through the filling conduit and through the filling opening; and a plurality of sealing flaps disposed on the free end of said filling conduit; and a pocket flap disposed on at least one of said plurality of flaps, the pocket flap forming a pocket for receiving a keepsake;

whereby said fabric shell is adapted for receiving a filling material inserted through said filling conduit into said hollow interior of said fabric shell.

2. The closure for a doll with keepsake photo according to claim 1, wherein said pocket is dimensioned and configured for receiving a photo.

3. The closure for a doll with keepsake photo according to claim 1, wherein said plurality of sealing flaps consists of two sealing flaps.

4. The closure for a doll with keepsake photo according to claim 1, further comprising a plurality of outer closure ties, the outer closure ties each having a first end fastened to said fabric shell adjacent to said filling opening and a free second end.

5. The closure for a doll with keepsake photo according to claim 4, wherein said plurality of outer closure ties are made of a lightweight flexible fabric.

6. The closure for a doll with keepsake photo according to claim 5, wherein said plurality of outer closure ties consists of two closure ties.

7. The closure for a doll with keepsake photo according to claim 1, further comprising first and second strips of hook and loop fastening material, said strips being disposed on an outer surface of said filling conduit as said filling conduit is extended outward from said fabric shell, said strips being adjacent to an edge of said opening.

8. A closure for a doll with keepsake photo, comprising:

a fabric shell having a filling opening defined therein, the fabric shell having a hollow interior, the filling opening being in communication with the hollow interior of the fabric shell;

a filling conduit having a free end and a secured end, the secured end being secured to said fabric shell adjacent to said filling opening, the free end being in communication with said hollow interior through the filling conduit and through the filling opening;

a plurality of sealing flaps disposed on the free end of said filling conduit, the sealing flaps being coated with a heat-activated adhesive; and a pocket flap disposed on at least one of said plurality of flaps, the pocket flap forming a pocket for receiving a keepsake;

whereby said fabric shell is adapted for receiving a filling material inserted through said filling conduit into said hollow interior of said fabric shell, said filling conduit being sealed closed by heating said sealing flaps in order to bond said sealing flaps together.

* * * * *